US010450890B2

(12) United States Patent
Menheere et al.

(10) Patent No.: US 10,450,890 B2
(45) Date of Patent: Oct. 22, 2019

(54) VARIABLE STATOR GUIDE VANE SYSTEM

(71) Applicant: PRATT & WHITNEY CANADA CORP., Longueuil (CA)

(72) Inventors: David Menheere, Norval (CA); Andrew Marshall, Grand Valley (CA); Richard A. Kostka, Bolton (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 64 days.

(21) Appl. No.: 15/698,905

(22) Filed: Sep. 8, 2017

(65) Prior Publication Data

US 2019/0078460 A1 Mar. 14, 2019

(51) Int. Cl.

| | |
|---|---|
| ***F01D 17/16*** | (2006.01) |
| ***F01D 9/04*** | (2006.01) |
| ***F04D 29/56*** | (2006.01) |

(52) U.S. Cl.

CPC ..... *F01D 17/162* (2013.01); *F01D 9/041* (2013.01); *F04D 29/563* (2013.01); *F05D 2240/12* (2013.01); *F05D 2260/38* (2013.01); *F05D 2260/53* (2013.01)

(58) Field of Classification Search

CPC ..... F16H 57/12; F16H 37/04; F04D 29/644; F04D 27/0246; F04D 29/563; F01D 17/165; F01D 17/162; Y10T 29/4932; F05D 2260/53; F05D 2260/4031; F05D 2250/90

See application file for complete search history.

(56) References Cited

U.S. PATENT DOCUMENTS

| | | | | |
|---|---|---|---|---|
| 2,933,235 | A | 4/1960 | Neumann | |
| 3,352,537 | A | 11/1967 | Petrie | |
| 5,620,301 | A * | 4/1997 | Lawer | F01D 17/162 415/150 |
| 5,630,701 | A * | 5/1997 | Lawer | F01D 17/162 415/160 |
| 6,928,818 | B1 * | 8/2005 | Arnold | F01D 17/165 415/148 |
| 8,079,217 | B2 | 12/2011 | Li et al. | |
| 8,240,983 | B2 | 8/2012 | Suljak, Jr. et al. | |
| 2009/0104022 | A1 * | 4/2009 | Suljak, Jr. | F01D 17/162 415/160 |
| 2011/0194904 | A1 | 8/2011 | Carlson | |
| 2012/0308364 | A1 | 12/2012 | Hofmann | |
| 2015/0204439 | A1 * | 7/2015 | Marshall | F16H 57/12 415/160 |
| 2016/0230586 | A1 | 8/2016 | King et al. | |

FOREIGN PATENT DOCUMENTS

| | | |
|---|---|---|
| GB | 2792301867 | 12/1996 |

* cited by examiner

*Primary Examiner* — Sizo B Vilakazi

(74) *Attorney, Agent, or Firm* — Norton Rose Fulbright Canada L.L.P.

(57) ABSTRACT

A variable stator guide vane system for a gas turbine engine comprises a set of vanes circumferentially distributed around a central axis and rotatably mounted for rotation about respective spanwise axes. A ring gear is rotatably mounted about the central axis. Pinion gears are operatively coupled to respective ones of the vanes and in driving engagement with the ring gear. Biasing members individually bias the pinion gears in meshing engagement with the ring gear.

16 Claims, 4 Drawing Sheets

VARIABLE STATOR GUIDE VANE SYSTEM

TECHNICAL FIELD

The application relates generally to gas turbine engines and, more particularly, to variable stator vanes used in such engines.

BACKGROUND OF THE ART

Many gas turbine engines incorporate variable stator vanes, the angle of attack of which can be adjusted. Gears are sometimes used to pivot the vanes. Gear teeth tolerances allow a play between the teeth of the gears. Such play might cause wear due to chatter introduced by backlash/hysteresis.

SUMMARY

In accordance with a general aspect, there is provided a variable stator guide vane system for a gas turbine engine, the system comprising: a set of vanes circumferentially distributed around a central axis and rotatably mounted for rotation about respective spanwise axes of the vanes; a ring gear rotatably mounted about the central axis; pinion gears operatively coupled to said vanes and in driving engagement with the ring gear; and biasing members biasing the pinion gears in meshing engagement with the ring gear.

In accordance with another general aspect, there is provided a gas turbine engine comprising: a casing circumferentially extending around a central axis; vanes circumferentially distributed around the central axis, the vanes rotatably mounted to the casing for rotation about respective spanwise axes of the vanes; a ring gear rotatably mounted to the casing for rotation about the central axis; pinion gears drivingly coupled to the vanes and in meshing engagement with the ring gear; and biasing members individually urging the pinion gears in meshing engagement with the ring gear.

In accordance with a still further general aspect, there is provided a method of operating a variable stator guide vane system having a set of variable guide vanes circumferentially distributed around a central axis and rotatably mounted to a casing for rotation about respective spanwise axes, the method comprising: engaging a ring gear rotatable about the central axis with pinion gears rotatable with the vanes about the spanwise axes such that a rotation of the ring gear around the central axis causes the vanes to rotate about the spanwise axes thereof; and independently urging the pinion gears in meshing engagement with the ring gear.

DESCRIPTION OF THE DRAWINGS

Reference is now made to the accompanying figures in which.

DETAILED DESCRIPTION

Figure 1:
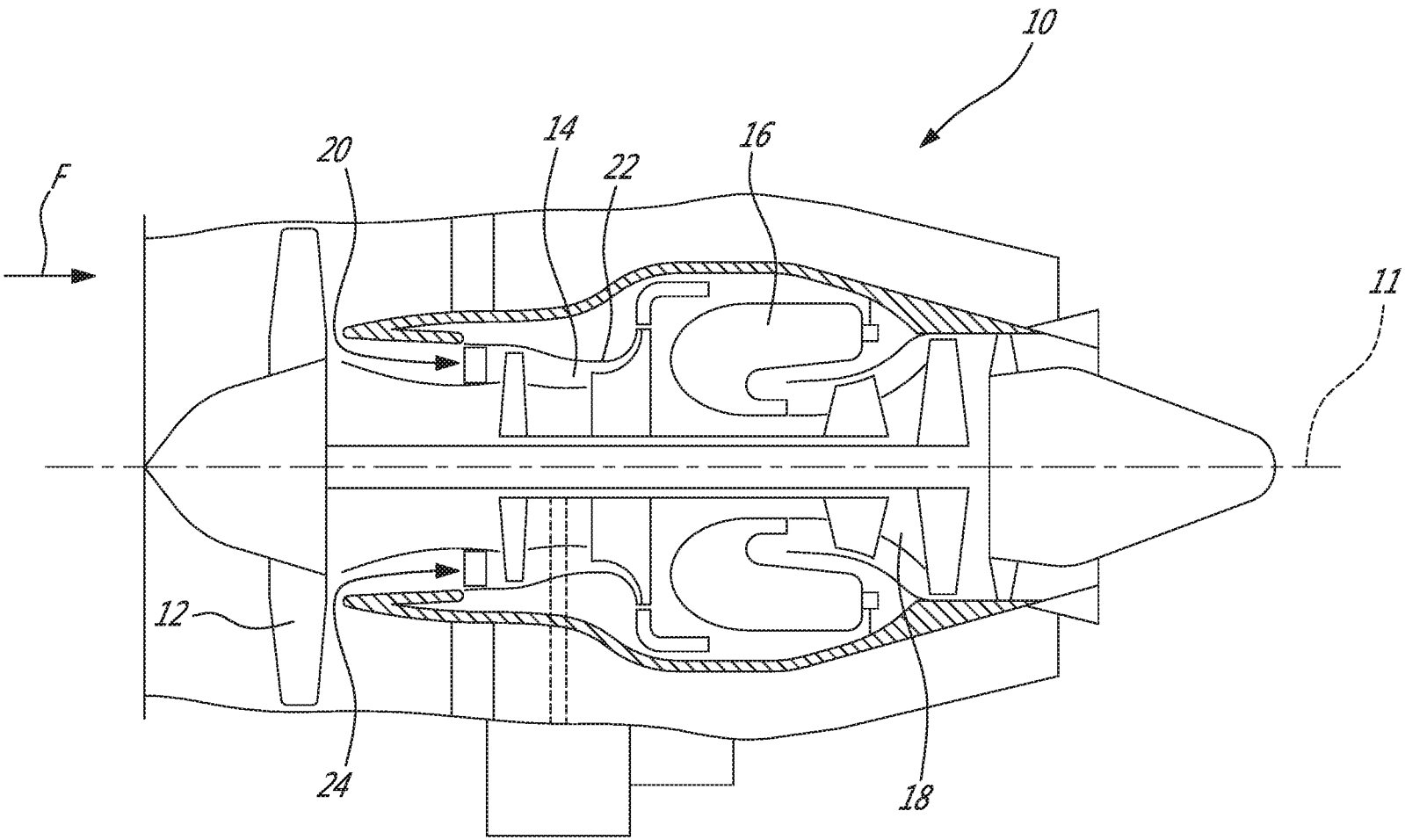
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are configured for rotation about a central axis 11 of the gas turbine engine 10.

In the embodiment shown, a variable stator guide vane system 20 is disposed at an inlet of the compressor section 14 for receiving a flow of air denoted by arrow F. The variable stator guide vane system 20 is configured to orient the flow before entering the first stage of compressor blade of the compressor section 14. The system 20 is configured to vary an angle of attack of its vanes depending of the operating conditions of the gas turbine engine 10. However, it is understood that the variable stator guide vane system may be used at other locations within the engine 10.

Figure 2:
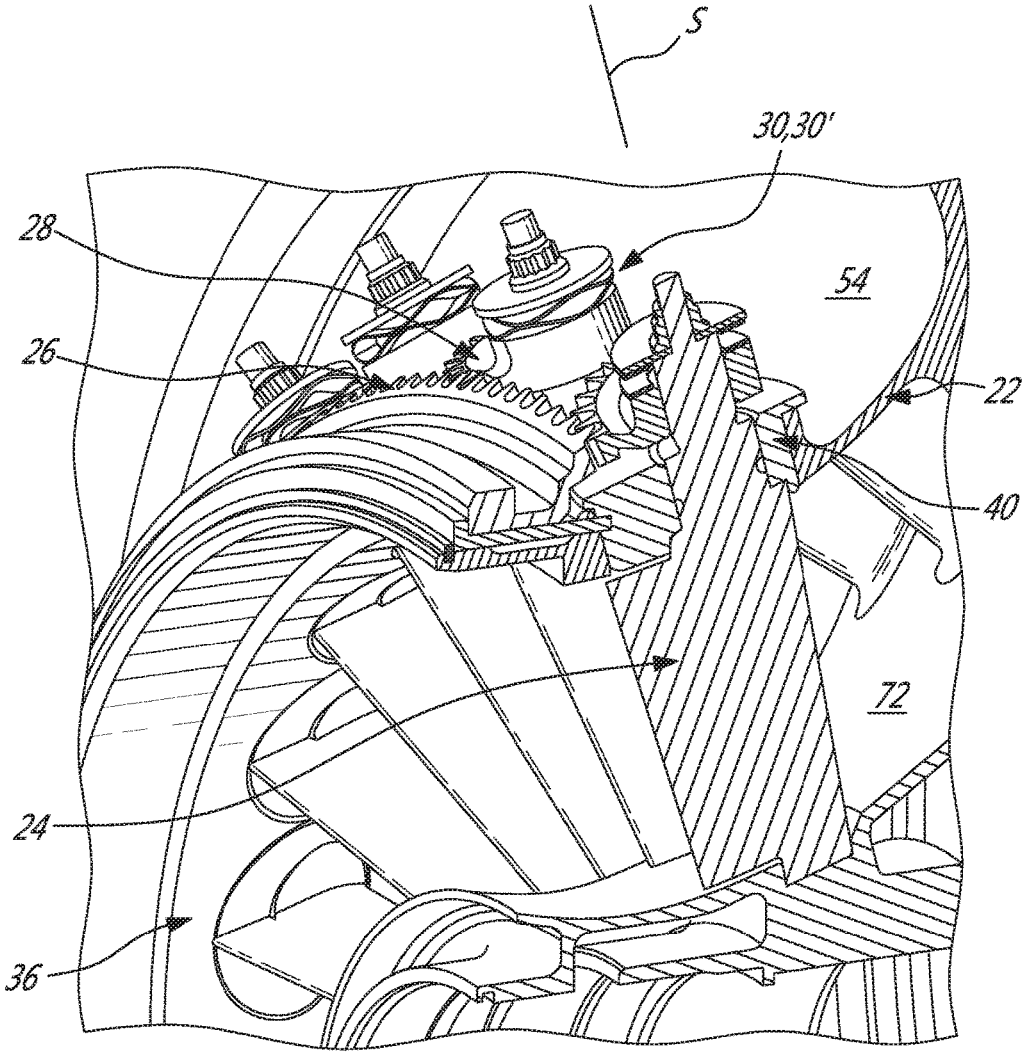
FIG. 2 is a tridimensional cross-sectional view of a variable stator guide vane system of the gas turbine engine of FIG. 1.

Referring now to FIG. 2, the variable stator guide vane system 20 comprises a casing 22 circumferentially extending around the central axis 11 and a plurality of vanes 24 circumferentially distributed around the central axis 11. The vanes 24 are rotatably mounted to the casing 22 for rotation about respective spanwise axes S. The system further includes a ring gear 26 rotatably mounted onto the casing 22 for rotation about the central axis 11. Each of the vanes 24 has a pinion gear 28 operatively coupled thereto and in driving engagement with the ring gear 26. Rotation of the ring gear 26 about the central axis induces rotation of the vanes 24 about their respective spanwise axes S. Therefore, the angle of attack of the vanes 24 may be varied by controlling a rotation of the ring gear 26. Any suitable actuator may be used to drive the ring gear 26, or to rotate one or more of the pinion gears 28.

When teeth of the pinion gears 28 engage teeth of the ring gear 26, a clearance may be defined therebetween. Therefore, the angle of attack of the vanes 24 may vary slightly in both directions because of this clearance. Such a clearance is typically a consequence of manufacturing tolerances. The clearance may cause wear of the gear teeth due to chatter introduced by backlash of the pinion gears 28 relative to the ring gear 26. Stated otherwise, this clearance allows teeth of the pinion gears 28 to repetitively impact teeth of the ring gear 26 which may cause premature wear of said gears. Such an impact may be induced by the flow passing through the stator guide vane system 20 and/or it may be the consequence of normal vibrations of the engine 10 when in operation.

In the embodiment shown, biasing members 30 are operatively mounted to the vanes 24 for urging each of the pinion gears 28 against the ring gear 26. In other words, the biasing members 30 individually bias the pinion gears 28 in the meshing engagement with the ring gear 26. Such a forced meshing engagement might decrease the clearance and the backlash between the ring and pinion gears and hence might reduce the wear. In the embodiment shown, the biasing members 30 are springs 30' but any suitable biasing members may be used, such as, pneumatic or hydraulic means. In the embodiment shown, the springs 30', are wave springs but it is understood that any other suitable springs may be used, such as coil springs.

In the embodiment shown, the meshing engagement between one of the pinion gears 28 and the ring gear 26 is controlled individually and independently from the meshing engagement between the remainder of the pinion gears 28 and the ring gear 26. This is possible because the pinion gears 28 are individually urged in meshing engagement with the ring gear 26 by their respective biasing member 30. Therefore, displacements of the pinion gears 28 about the spanwise axes S may be different from one another. This may allow to cater to the different shapes of pinion gears 28 that may slightly vary from one another because of manufacturing tolerances. Therefore, such an embodiment might allow the relaxation of the manufacturing tolerances of the different parts of the system 20 and, at the same time, might offer better control of the vane accuracy. The reduction of the clearance between the gears 26 and 28 might allow a more accurate control over the vane angular position that may result in performance/operability improvement through the operating range. The relaxation of the manufacturing tolerances may reduce manufacturing costs. Moreover, thermal lock of the ring and pinion gears 26 and 28 may be avoided because expansion/contraction of the system due to temperature variations is accommodated by the biasing members 30.

In the embodiment shown, the pinion gears 28 are slidably mounted over spindles extending spanwise from the radially outer end of respective vanes. The biasing members 30 are operative to bias the pinion gears 28 toward the ring gear 26 along the spanwise axes. In other words, a force between the ring and pinion gears 26 and 28 increases by moving the pinion gears 28 inwardly toward the central axis 11 and along the spanwise axes S. In the embodiment shown, the ring and pinion gears 26 and 28 are beveled relative to the span wise axes S. Stated otherwise, pitch surfaces of the pinion gears 28 and of the ring gear 26 have frustoconical shapes. The pitch surface of a gear is an imaginary plane that rolls about an axis of rotation of the gear.

Figure 3:
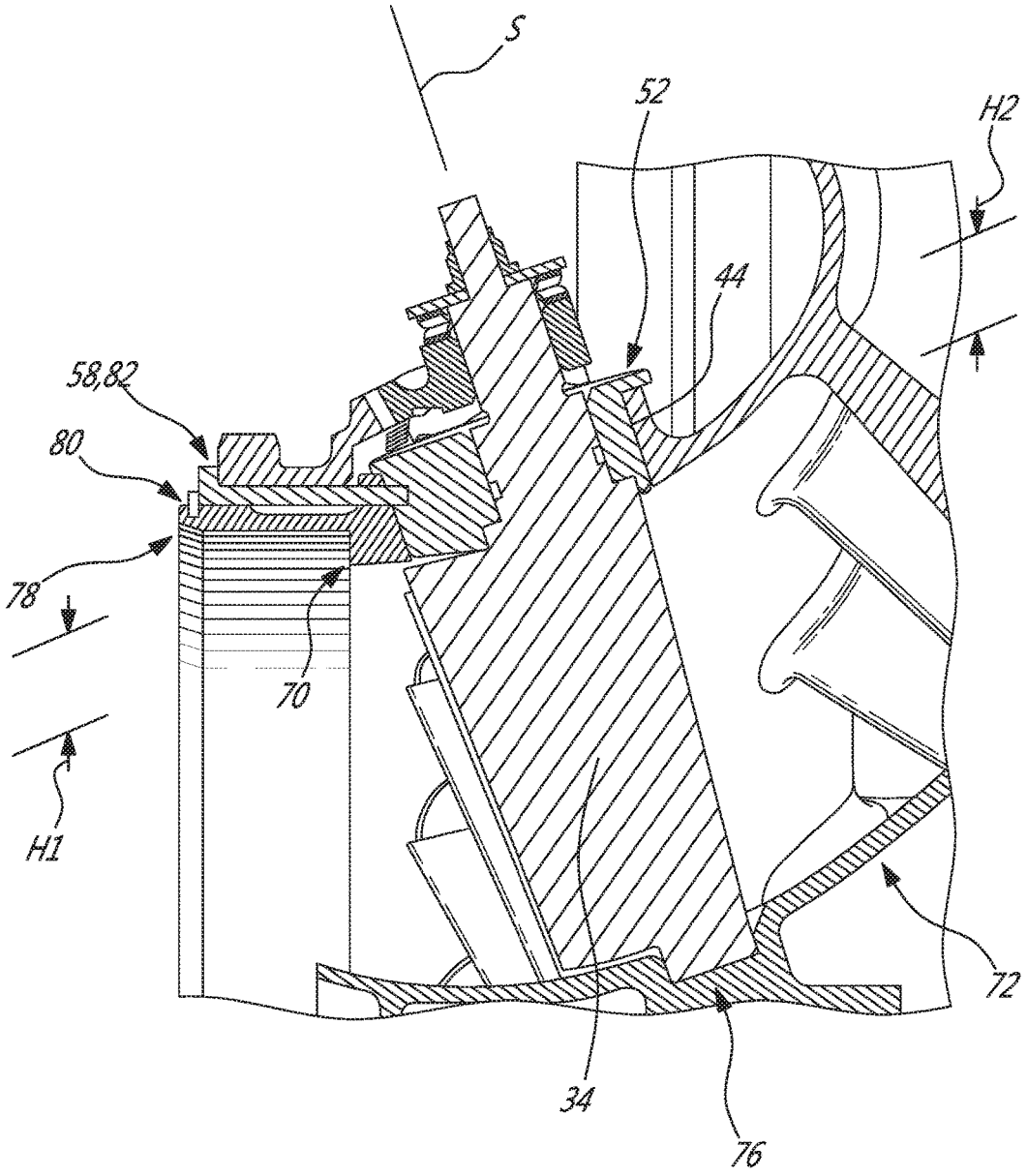
FIG. 3 is the tridimensional cross-sectional view of FIG. 2 illustrated at a different viewing angle.
Figure 4:
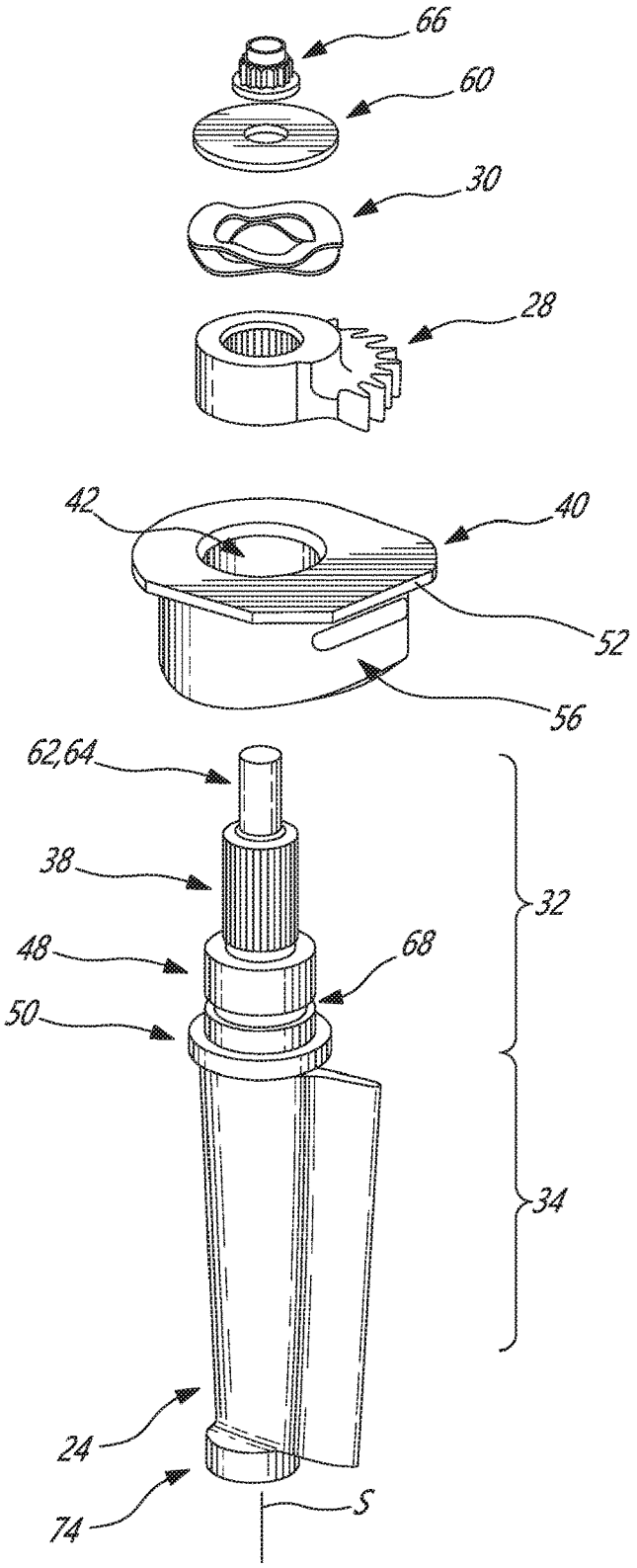
FIG. 4 is tridimensional exploded view of one of the vanes of the variable stator guide vane system of FIG. 2.

Referring now also to FIGS. 3-4, the vanes 24 have mounting portions 32 and vane portions 34 offset from the mounting portions 32 relative to the spanwise axes S. In the embodiment shown, the mounting portions 32 are received through apertures 36 defined through the casing 22. The mounting portions 32 each define a spline 38 for creating a spline coupling between the pinion gears 28 and the vanes 26. The spline coupling locks the pinion gears 28 in rotation with the vanes 24 about the respective spanwise axes while allowing axial translation of the pinion gears 28 about said axes.

In the embodiment shown, the system 20 further includes bushings 40 configured to be received within the apertures 36 defined through the casing 22. The bushings 40 define bores 42 for receiving the spindle portion of the vane mounting portions 32 and are therefore configured to be disposed between peripheral surfaces 44 of the casing apertures 36 and the vane mounting portions 32. More specifically, the vane mounting portions 32 define cylindrical sections 48 disposed between the splines 38 and the airfoil portions 34 of the vanes 24. The cylindrical sections 48 have outer cylindrical surfaces for sliding against cylindrical inner surfaces of the bushing bores 42.

Referring more particularly to FIGS. 3 and 4, to install the system 20, the bushings 40 are disposed around the vane mounting portions 32 until they abut against abutment sections 50 of the vanes mounting portions 32. The abutment sections 50 are between the cylindrical sections 48 and the airfoil portions 34 and have a diameter greater than that of the cylindrical sections 48. Then, the vanes 24 are inserted through the casing apertures 36 toward the central axis 11 until annular tabs 52 of the bushings 40 abut against an outer surface 54 of the casing 22. Then, the bushings 40 are rotated relative to the spanwise axes S until grooves 56 of the bushings 40 engage an annular bushing 58 disposed radially between the ring gear 26 and the casing 22 to lock the bushings 40 within the casing 22 thereby limiting translation of the bushings 40 relative to the span wise axes S. Then, the pinion gears 28 are disposed around the splines 38 and meshed with the ring gear 26 that is disposed around the casing 22. Once meshed with the ring gear 26, the pinion gears 28 remain spaced apart from the bushings 40 relative to the spanwise axes S. Then, the biasing members 30 are engaged over the vane mounting portions 32 and sandwiched against the pinion gears 28 with washers 60. Outward extremities 62 of the vanes 24 define threaded sections 64 receiving nuts 66 screwed thereon to lock the different parts together. In the embodiment shown, the nuts 66 are screwed at least until compression of the springs 30' begin.

Referring more particularly to FIG. 4, the cylindrical sections 48 define each an annular groove 68 configured for receiving an O-ring. The O-ring is configured to seal the engagement between the vane mounting portions 32 and the bushings 40. Other configurations are contemplated.

In the embodiment shown, the outer surface 54 of the casing 22 define an elevated portion 70 such that a height H1 of the casing aperture peripheral surfaces 44 taken along the span wise axes S substantially corresponds to a height 42 of the bushings 40 less a thickness of annular tabs 52. The annular tabs 52 of the bushings 40 abut against the elevated portion 70 of the outer surface 54.

In the embodiment shown, the vanes 24 are retained by the bushings 40 on a radially outward extremity and by an inner casing 72 on a radially inward extremity. More specifically, radially inward portions of the vanes 24 includes a cylindrical portion 74 configured to be rotatably received within suitable cavities 76 defined in the inner casing 72 to allow rotation of the vanes 24 about the span wise axes S.

Referring more particularly to FIG. 3, the ring gear 26 is disposed axially forward of the pinion gears 28 relative to the central axis 11 and radially outward to the casing 22. The axial position is maintained by the pinion gears 28 on one side and by the annular busing 58 on the other side. More specifically, an axially rearward extremity of the casing 22 define an annular groove 78 receiving a ring 80. The ring 80 limits a rearward movement of the annular bushing 58. The annular bushing 58 has an L-shape and as such has a portion 82 extending radially outwardly from the casing 22. The portion 82 limits a rearward movement of the ring gear 28 relative to the casing 22.

Referring to all figures, to operate the variable stator guide vane system 20, the vanes 24 are circumferentially distributed about the central axis 11 of the casing 22 for rotation about the span wise axes S. Then, the ring gear 26 is engaged with the pinion gears that are rotatable with the vanes 24 about the spanwise axes S such that a rotation of the ring gear around the central axis is transmittable in rotations of the vanes 24 about the spanwise axes S. Then, the pinion gears 28 are independently urged in meshing engagement with the ring gear 26.

In the illustrated embodiment, the pinion gears 28 are pushed along the spanwise axes S toward the ring gear 26. In the embodiment shown, pushing the pinion gears 28 toward the ring gear 26 comprises pushing the pinion gears 28 toward the airfoil portions 34 of the vanes 24. Then, the ring gear 26 is rotated to change the angle of attack of the vanes relative to the incoming flow.

In a particular embodiment, the ring and pinion gears 26 and 28 may be disposed in a radially inward portion of the vanes 24. In a particular embodiment, the bevel angle of the ring and pinion gears 26 and 28 may be different such that the biasing members 30 push, or pull, the pinion gears 28 away from the vane airfoil portions 34. Other configurations are contemplated without departing from the scope of the present disclosure.

The ring gear 26 may be manufactured from composite and the teeth may be coated with nano nickel. The ring gear 26 may be constructed from metallic or ceramic materials. The pinion gears 28 may be made from similar materials as the ring gear 26. The gears may be manufactured using traditional manufacturing methods, such as, powder metallurgy, injection molding, additive manufacturing, or any suitable method. The springs 30' may be made of composite, traditional spring materials, or any suitable materials. The bushings 40 and 58 may be Vespel™ composite bushings.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A variable stator guide vane system for a gas turbine engine, the system comprising: a set of vanes circumferentially distributed around a central axis and rotatably mounted for rotation about respective spanwise axes of the vanes; a ring gear rotatably mounted about the central axis; pinion gears operatively coupled to said vanes and in driving engagement with the ring gear; and biasing members biasing the pinion gears in meshing engagement with the ring gear, wherein the pinion gears are slidably engaged on spindles projecting spanwise from the vanes, the biasing members individually biasing the pinion gears toward the ring gear along the spanwise axes.

2. The system of claim 1, wherein the ring gear and the pinion gears are beveled.

3. The system of claim 1, wherein the spindles project through respective bushings mounted to an outer casing surrounding respective airfoil portions of the vanes.

4. The system of claim 1, wherein the biasing members include individual springs spring loading the pinion gears along the spanwise axes.

5. The system of claim 1, wherein the vanes have spindles projecting along the spanwise axes from airfoil portions, the spindles extending through circumferentially spaced-apart apertures defined through a vane inlet casing.

6. The system of claim 5, further comprising bushings disposed in the circumferentially spaced-apart apertures for receiving the spindles of the vanes.

7. The system of claim 1, wherein the vanes are inlet guide vanes of a compressor of the gas turbine engine.

8. A gas turbine engine comprising: a casing circumferentially extending around a central axis; vanes circumferentially distributed around the central axis, the vanes rotatably mounted to the casing for rotation about respective spanwise axes of the vanes; a ring gear rotatably mounted to the casing for rotation about the central axis; pinion gears drivingly coupled to the vanes and in meshing engagement with the ring gear; and biasing members individually urging the pinion gears in meshing engagement with the ring gear, wherein the pinion gears are slidably engaged on spindles projecting spanwise from the vanes, the biasing members biasing the pinion gears toward the ring gear along the spanwise axes.

9. The gas turbine engine of claim 8, wherein the ring gear and the pinion gears are beveled.

10. The gas turbine engine of claim 8, wherein the vanes have mounting portions and airfoil portions offset from the mounting portions relative to the spanwise axes, the casing being an outer casing surrounding the airfoil portions of the vanes.

11. The gas turbine engine of claim 8, wherein the biasing members include springs.

12. The gas turbine engine of claim 8, wherein the vanes have mounting portions and airfoil portions offset from the mounting portions relative to the spanwise axes, the mounting portions extending through apertures defined through the casing.

13. The gas turbine engine of claim 12, further comprising bushings disposed between the mounting portions of the vanes and peripheral surfaces of the apertures.

14. The gas turbine engine of claim 8, wherein the vane are inlet guide vanes of a compressor stage.

15. A method of operating a variable stator guide vane system having a set of variable guide vanes circumferentially distributed around a central axis and rotatably mounted to a casing for rotation about respective spanwise axes, the method comprising:

engaging a ring gear rotatable about the central axis with pinion gears rotatable with the vanes about the spanwise axes such that a rotation of the ring gear around the central axis causes the vanes to rotate about the spanwise axes thereof; and independently urging the pinion gears in meshing engagement with the ring gear;

wherein independently urging the pinion gears comprises pushing the pinion gears radially along the spanwise axes of respective vanes.

16. The method of claim 15, wherein pushing the pinion gears comprises pushing the pinion gears in a radially inward direction relative to the central axis.

* * * * *